United States Patent [19]

Robinson

[11] 4,288,650

[45] Sep. 8, 1981

[54] ELECTRICAL INSULATION DEVICE

[75] Inventor: Michael Robinson, Wooton, England

[73] Assignee: LaPorte Industries Limited, London, England

[21] Appl. No.: 22,319

[22] Filed: Mar. 20, 1979

[30] Foreign Application Priority Data

Mar. 23, 1978 [GB] United Kingdom ..... 11612/78

[51] Int. Cl.[3] ..... H05H 1/26

[52] U.S. Cl. ..... 13/2 P; 219/121 PM; 219/121 PP

[58] Field of Search ..... 13/2, 2 P; 219/121.12, 219/121.13, 121.14, 121.17, 121 PM, 121 PN, 121 PP, 121 PR

[56] References Cited

U.S. PATENT DOCUMENTS 2,960,594 11/1960 Thorpe ..... 219/121.13

3,914,573 10/1975 Muehlberger ..... 219/121.13

*Primary Examiner*—Roy N. Envall, Jr.

*Attorney, Agent, or Firm*—Kane, Dalsimer, Kane, Sullivan and Kurucz

[57] ABSTRACT

Electrical insulation may be provided between two parts of a structure intended for exposure to high temperature radiation from a heat source, e.g. the interior wall of an electrical discharge furnace, by providing slot in the structure positioned so that the base of the slot cannot view the heat source directly. The slot may have flared lips, sides generally angled away from each other in the direction of increasing temperature, provision for a flow of gas in the same direction and provision for cooling the material bridging the base of the slot to a temperature at which it may be electrically insulating.

27 Claims, 5 Drawing Figures

ELECTRICAL INSULATION DEVICE

FIELD OF THE INVENTION

This invention relates to an electrical insulation device.

BACKGROUND OF THE INVENTION

Many industrial processes now in operation require the generation of temperature in the region of, or in excess of, 1000° K. Traditionally, such temperatures have been attained by means of furnaces operating on the principle of chemical combustion wher in the process is conducted in the presence of a combustion flame. Such furnaces have the disadvantage of involving the introduction of combustion materials and combustion products into the process.

Of recent years furnaces using a heat source comprising an electrical discharge have come more into consideration. Such furnaces may be, for example, arc furnaces or may be, for example, "plasma" furnaces in which discharge at an electrode heats a flow of inert gas into a heating chamber. Furnaces of either type can provide temperatures in excess of 5000° K. although the area in which they are mainly under development is in the temperature range of about 1500° K. to 3000° K. since at such temperatures the physical problems of providing a structure for the containment of the electrical discharge are more easily solved than at higher temperatures. In the field of ore, or ore derivative, processing the last mentioned range is of particular interest since it is below the temperature at which iron starts to volatalise.

The electrical insulation of electrical discharge furnaces, or of parts thereof from the remainder of a furnace, has proved to present a problem which, unless solved, greatly reduces their efficiency. This problem arises from the fact that many materials normally used, or of potential use, in furnace construction as electrical insulators can become electrically conductive to varying degrees at the temperatures involved in electrical discharge furnace operation, for example, at temperatures in excess of 1500° K.

Because of the difficulty in insulating the discharge source, for example an electrode, from the surrounding furnace structure, it is known to space the electrode from the furnace walls. There is a tendency for unwanted sporadic electrical discharge over the resulting gap and this may be a source of wear of the electrode structure resulting in reduced electrode life. Such wear may be particularly serious in plasma furnaces where the electrode assembly may be a complicated and expensive part of the furnace.

The visual and infra-red radiation inside an electrical discharge furnace is intense and efficient thermal insulation of the heating zone is necessary not only for efficiency but to enable the economic construction of at least some parts of the furnace not directly exposed to such radiation from materials not capable of withstanding the full effects thereof.

One possibility for reducing the problem of electrode wear due to sporadic discharges across the spacing between it and the furnace walls is to increase that spacing. However, this may allow the direct escape of radiation from the heating zone and the exposure to such radiation of the mechanical structure supporting the electrode and is therefore not always a practical solution to the problem. This may be particularly so where a moveable electrode is employed and the supporting structure incorporates mechanical linkages which may be prone to heat distortion.

The problems outlined above cannot be cured satisfactorily in practice solely by direct cooling to counteract the loss in insulating properties. This is because only the bulk of material of construction of the furnace immediately adjacent to the cooling means becomes non-conductive and, therefore, the cooling means has to be positioned in the material of construction very close to the heat-exposed surface. This results in potential structural weakness in the furnace and a high rate of power loss by heat transfer. Heat transfer rates are also, generally, not high enough to reduce the temperature of the material sufficiently to obtain the desired result.

SUMMARY OF THE INVENTION

According to one aspect thereof the present invention provides a structure requiring electrical insulation between two parts thereof a surface of the structure being intended for exposure in use in a furnace to radiation from a heat source having a temperature sufficiently elevated to cause a reduction in the electrically insulating properties of normally insulating constructional materials, characterised by the provision of a slot in the structure between the two parts thereof the slot extending from the heat exposed surface of the structure into the depth of the structure the slot being positioned and dimensioned so that the base of the slot would not view the heat source in use.

Certain embodiments of the invention will now be described with reference to the accompanying drawings which are all diagrammatic and not to scale.

BRIEF DESCRIPTION OF THE DRAWINGS

The Figures all represent horizontal sections through a cylindrical furnace or a part thereof.

DETAILED DESCRIPTION OF THE DRAWINGS

Figure 1:
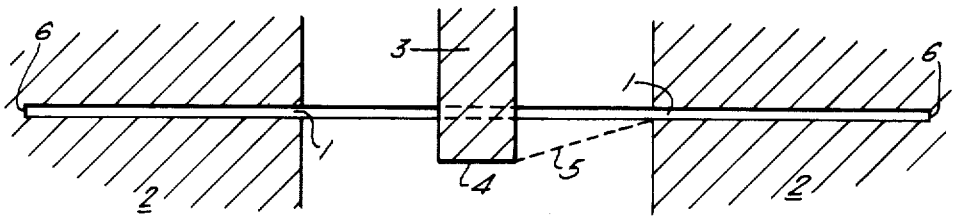
FIG. 1 illustrates the positioning of a slot in relation to an electrode.
Figure 2:
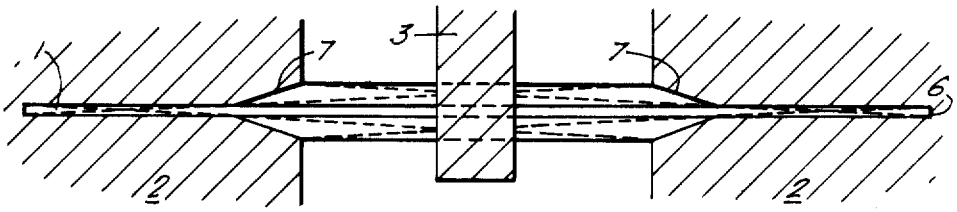
FIG. 2 illustrates the flaring of a slot and its effect on the "line of sight" view from the base of a slot.

Referring to FIGS. 1 and 2 an annular slot 1 in the furnace wall 2 is flared at 7 so that, in use, no part of the base 6 of the slot, can view directly except into the flared portion of the part of the slot diametrically opposite across the furnace. The dashed line 5 represents a notional line of sight from the discharge surface 4 of electrode 3 to the slot 1.

The base of the slot does not view the heat source or other element hereinafter referred to if notional lines of sight from the said base cannot impinge on said source or element.

Figure 5:
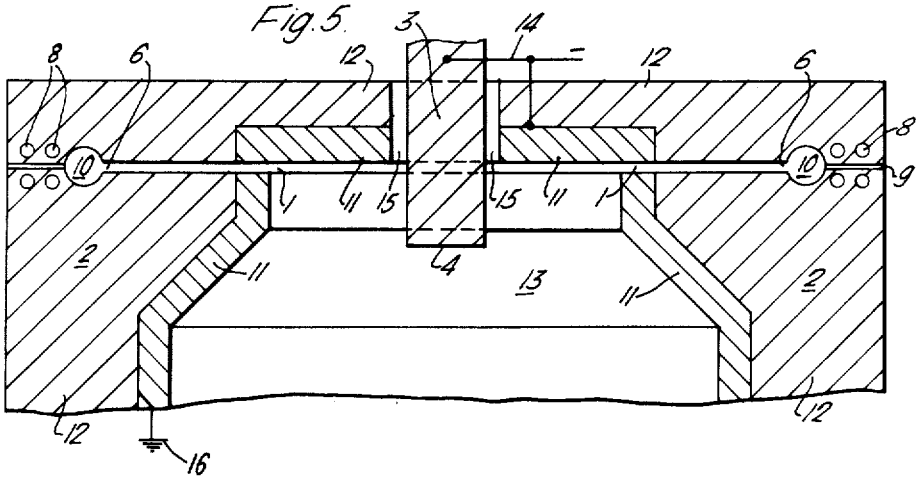
FIG. 5 illustrates a furnace top and the use of a gas supply conduit, cooling ducts, and the electrical connection of an electrode to the furnace top.

It is understood that the slot in the structure may be formed by cutting, or by the juxta-position of two preformed structures suitably shaped, or by the preforming of a single structure in the required shape or by any other means. A slot is understood to have finite depth and the term is understood to exclude a gap passing completely through a structure. In the case where it is desired to insulate the top of a cylindrical furnace from the remainder of the furnace by means of the invention the slot is envisaged to be annular as shown in FIG. 5. Preferably the slot lies in the structure substantially at right angles to the heat exposed surface thereof.

There is a non-arithmetrical relationship between the maximum discharge distance across a gap and the temperature of the gas in the gap. For example, at 250 volts potential difference, the maximum discharge distance approximately trebles for a temperature increase from 1000° K. to 2000° K. Since we envisage a temperature profile to become established in a slot, particularly one having cooling near to its base, the most efficient profile for the slot to prevent discharge is one in which the sides of the slot are angled away from each other somewhat in the direction of increasing temperature. Alternatively the slot may have parallel sides at least over a majority of its depth. The optimum configuration of the slot is preferably determined by the application of Paschen's Law although constructional considerations may lead to modifications of a theoretically optimum profile. The slot may, within the invention, pass through a composite structure such as a initial furnace lining backed by a thermally insulating layer since electrical insulation problems arising from the use of high temperatures may also apply to such a layer.

Since it is desired to avoid undue radiation into the depth of the slot, the slot is preferably deep and has the smallest opening consistent with efficient discharge retardation.

Preferably, so that radiation from other surfaces which are themselves at elevated temperature penetrating its total depth in use is reduced, the slot is positioned so that the base of the slot does not view in use, any other surface positioned normal to a line of sight from the base of the slot and itself exposed to direct radiation from the heat source. Preferably in the case where the slot is a continuing slot about an inner furnace wall, it views another portion of the same slot. Alternatively or additionally the base of the slot may view other surfaces shielded from direct radiation from the heat source.

According to one advantageous feature one or both lips of the slot may be flared outwardly at 7 so as to decrease the amount of heat exposed surface which the notional lines of sight from the base of other portions of the slot can impinge on across the furnace. Surprisingly, provided that the flaring is not too marked, an efficient compromise between the amount of extra direct radiation falling on the mouth of the slot and the decrease in the exposure of the depth of the slot to radiation can be achieved. Without being bound to the following theory we believe that this effect is at least in part due to a tendency for a furnace wall to absorb radiation and re-emit it, to a large extent normal to the wall, in preference to, but not to the complete exclusion of, reflection at an angle equal to the angle of incidence with the wall. Preferably the flaring is such that the base of the slot would view the flaring of another portion of the slot, the slot being an annular one about the inner wall of a furnace chamber. Suitable dimensions for a slot in a furnace wall having a heat exposed surface temperature of about 2173° K. where the potential difference between the sides of the slot is up to about 600 volts are as set out below.

The portion of the furnace in which the slot lies is 265 mm in internal diameter and the slot is an annular slot in the furnace walls having a depth of 450 mm. The base of the slot, due to cooling, has a temperature of 150° and the slot is, at the base, 6 mm wide. One side of the slot is at right angles to the heat exposed surface and extends in a straight line to the base of the slot. The other side of the slot is parallel to the first mentioned side for the first 130 mm from the base of the slot and is then flared outwardly twice stepwise to give a width of 14 mm at 370 mm from the base and 25.4 mm at the heat exposed surface.

Generally, it is envisaged that a slot would be at least 350 mm deep for example from 400 to 600 mm deep and at least 5 mm for example from 5 to 10 mm wide at the base of the slot.

Figure 3:
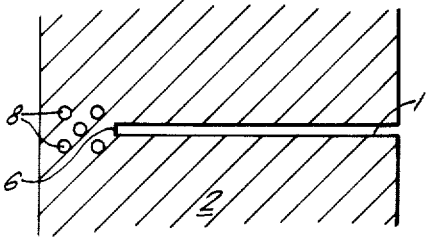
FIG. 3 illustrates the use of cooling ducts.

Cooling means for the part of the structure bridging base of the slot is preferably provided as shown in FIG. 3. Such cooling means may comprise coolant fluid ducts 8 in the material shown relative to base 6 of slot 1. A suitable coolant fluid may be selected according to known practice and may, for example, be water. Preferably the cooling means is capable of reducing the temperature of the material bridging the base of the slot to below 675° K. to retard the flow of electricity past the slot to a significant extent.

Figure 4:
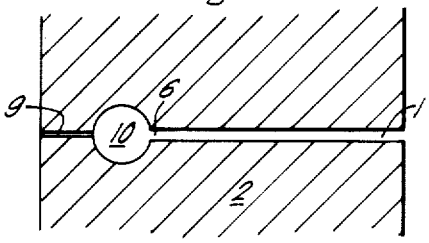
FIG. 4 illustrates the use of a gas supply conduit.

A feature which contributes to the effect of the invention is the provision of means to maintain a flow of gas to the base of the slot and, in the slot towards the heat exposed surface thereof. The gas fulfills a threefold purpose. Firstly it may have a cooling effect. Secondly it may be selected so as to be relatively less-conductive of electricity than the gas present in a furnace which may contain ionic species which encourage discharge initiation across the slot. Thirdly it may provide a means of clearing the slot of unwanted accumulations of solids which may occur when solids are being processed in a furnace. For this purpose chemically inert gases may suitably be used of which nitrogen is preferred. Preferably the base of the slot is shaped so as to provide a chamber 10 lying along the base of the slot having an increased surface area to augment cooling and to facilitate gas distribution in the slot. Gas may be supplied to the chamber 10, which may be annular in a cylindrical furnace or otherwise positioned as desired through spaced plurality of radial gas supply conduits 9 which are suitably, from 4 to 30 in number as shown in FIG. 4.

A limited amount of discharge across the slot can be tolerated. If an electrical connection is provided between the electrode structure and surrounding furnace structure and the slot is provided in the said surrounding structure, for example about the upper part of the side wall of the furnace chamber, discharge between the electrode and the surrounding structure may be prevented or reduced and any discharge which may take place may be across the slot. Wear at the slot surfaces may result but this is relatively inexpensive to repair in comparison with electrode wear. Suitably, the slot surfaces are protected by replaceable inserts.

With reference now to FIG. 5, a cross sectional view of a furnace is shown including many of the elements and advantages previously described. The furnace includes a furnace wall, shown generally as 2, comprises an inner refractory layer 11 and an outer thermally insulating layer 12. An annular slot 1 is positioned at the top of the furnace chamber 13 above the discharge surface 4 of the electrode 3. The base 6 of the slot 1 is provided with an annular gas distribution chamber 10 and a plurality of gas supply conduits 9. The furnace wall material is provided with cooling ducts 8. The electrode 3 has electrical connection 14 connected to the furnace wall 2 to prevent discharge occurring across the gap 15 in use. The furnace wall 2 is earthed 16 so that, in use, any discharge occurring across the slot 1 may be allowed to disperse.

Although a somewhat preferred embodiment has been disclosed and described in detail herein, it should be understood that this invention is in no sense limited thereby and its scope is to be determined by that of the appended claims.

We claim

1. A structure requiring electrical insulation between two parts thereof, a surface of the structure being intended for exposure in use in a furnace to radiation from a heat source having a temperature sufficiently elevated to cause a reduction in the electrically insulating properties of normally insulating constructional materials, characterised by the provision of a slot in the structure between the two parts thereof the slot extending from the heat exposed surface of the structure into the depth of the structure the slot being positioned and dimensioned so that the base of the slot would not view the heat source in use.

2. A structure as claimed in claim 1 including means of maintaining a flow of gas in the slot towards the heat exposed surface of the structure.

3. A structure as claimed in claim 2 comprising a gas supply duct connected to the base of the slot and a gas distribution chamber in the slot.

4. A structure as claimed in claim 1 including cooling means for the part of the structure bridging the base of the slot.

5. A structure as claimed in claim 4 comprising heat exchange ducts in the body of the structure.

6. A structure as claimed in claim 1 wherein the slot surfaces comprise replaceable inserts.

7. A structure as claimed in claim 1 wherein the slot is positioned so that the base of the slot does not view any surface itself exposed to direct radiation from the heat source which is positioned normal to a line of sight from the base of the slot.

8. A structure as claimed in claim 2 wherein the sides of the slot over at least a portion of the depth thereof are angled away from each other in the direction of increasing temperature in the slot thereby to compensate at least in part for the variation in the electrical conductivity of the gas in the slot.

9. A structure as claimed in claim 1 wherein the slot has a portion which is flared outwardly.

10. A structure as claimed in claim 9 wherein the base of the slot views the flaring of a like or the same slot.

11. A structure as claimed in claim 1 comprising an inner chamber wall and said slot extending continuously around the wall.

12. In an electrical discharge furnace having an operational temperature in excess of 1500° K. and comprising spaced electrode means for striking a discharge across the interior of the furnace and furnace wall comprising at least an inner refractory surface supporting and separating said electrode means, said furnace wall being electrically non-insulating in use by virtue of the furnace operational temperature, the improvement comprising provision of electrical insulation in the furnace wall by providing a slot extending circumferentially around the wall, extending from the inner surface of the wall into the depth thereof and being positioned and dimensioned so that the base of the slot would not view the electrical discharge in use, together with means for maintaining a flow of gas in the slot towards the inner surface of the wall and means to cool the material bridging the base of the slot to not more than 675° K. in use.

13. In an electrical discharge furnace comprising a spaced electrode means for striking a discharge across the interior of the furnace and furnace wall having an inner surface supporting and separating said electrode means, with said wall being electrically non-insulating in use at the operational temperature of the structure, the improvement comprising the provision of electrical insulation in said furnace wall by providing a slot therein, said slot being located about the circumference of said wall, extending from its inner surface to a base located at a depth of the wall, and being positioned and dimensioned so that the base would not view the electrical discharge.

14. A furnace as claimed in claim 13 which includes a means for maintaining a flow of gas in the slot towards the inner surface of the furnace wall.

15. A furnace as claimed in claim 14 comprising a gas supply duct connected to the base of the slot and a gas distribution chamber in the slot.

16. A furnace as claimed in claim 13 including a cooling means for the material bridging the base of the slot.

17. A furnace as claimed in claim 16 wherein said cooling means includes heat exchange ducts.

18. A furnace as claimed in claim 13 wherein the slot has surfaces comprising replaceable inserts.

19. A furnace as claimed in claim 16 wherein the temperature of the material bridging the base of the slot is maintained by the cooling means at a temperature not more than 675° K. in use.

20. A furnace as claimed in claim 13 wherein the slot is positioned so that the base of the slot does not view any surface itself expose to direct radiation from the electric discharge which is positioned normal to the line of sight from the base of the slot.

21. A furnace as claimed in claim 14 wherein the sides of the slot over at least a portion of the depth thereof are angled away from each other in the direction of increasing temperature in the slot thereby to compensate at least in part for the variation in electrical conductivity of the gas in the slot.

22. A furnace as claimed in claim 13 wherein the slot has a portion which is flared outwardly.

23. A furnace as claimed in claim 22 wherein the base of the slot views the flaring of a like or the same slot.

24. A furnace as claimed in claim 13 wherein said slot extends the full circumference of said wall.

25. A furnace as claimed in claim 13 wherein said electrode means is electrically connected to a portion of the furnace wall surrounding said electrode reducing the tendency for sporatic discharge to occur therebetween, with the remaining portion of the furnace wall separated therefrom by said slot.

26. A furnace as claimed in claim 13 wherein its inner surface is made of refractory material and is backed by a thermally insulating layer.

27. A furnace as claimed in any one of claims 13 through 26 wherein the said furnace has an operational temperature in excess of 1500° K.

* * * * *